United States Patent [19]

Devy et al.

[11] 4,081,160

[45] Mar. 28, 1978

[54] FAIL-SAFE CAB SIGNAL PROCESS FOR TRANSMITTING INFORMATION BY HIGH-VOLTAGE PULSED TRACK CIRCUITS, AND APPARATUS FOR CARRYING THE PROCESS INTO EFFECT

[75] Inventors: Robert C. Devy, Le Blanc Mesnil; Jean P. Salmon, Sevran, both of France

[73] Assignee: Jeumont-Schneider, Puteaux, France

[21] Appl. No.: 727,430

[22] Filed: Sep. 28, 1976

[30] Foreign Application Priority Data

Oct. 1, 1975 France ..... 75 30006

[51] Int. Cl.[2] ..... B61L 3/24

[52] U.S. Cl. ..... 246/63 C; 246/167 R

[58] Field of Search ..... 246/34 R, 34 CT, 63 R, 246/63 C, 187 B, 167 R; 340/47, 146.1 C, 147 SY, 167 R

[56] References Cited

U.S. PATENT DOCUMENTS

| | | | |
|---|---|---|---|
| 2,692,941 | 10/1954 | Sorensen | 246/34 R |
| 2,811,634 | 10/1957 | Hufnagel | 246/34 R |
| 3,337,727 | 8/1967 | Freeman | 246/63 C |
| 3,885,228 | 5/1975 | Katz et al. | 340/47 |

FOREIGN PATENT DOCUMENTS

| | | | |
|---|---|---|---|
| 1,073,678 | 3/1954 | France | 246/63 R |
| 1,180,196 | 12/1958 | France | 246/34 R |
| 2,051,914 | 4/1971 | France | 246/63 R |
| 2,109,117 | 5/1972 | France | 246/34 CT |

*Primary Examiner*—Stephen G. Kunin
*Attorney, Agent, or Firm*—Bacon & Thomas

[57] ABSTRACT

A method and apparatus is provided for communicating information in the form of plural items of data between a first station and a rail vehicle by transmission of pulses at predetermined repetition rates along railway tracks including a transmitting station for generating the information pulses having control apparatus receiving a particular data item as an input for selecting a repetition rate to represent the data item for transmission and generating apparatus connected to the control apparatus for generating the information pulses. The information pulses are coupled to railway tracks which transmit the generated information. A receiving station receives the information pulses from the tracks and includes sensing apparatus for sensing the information pulses and apparatus for removing interference signals received along with the information pulses, the interference signals being attributable to a number of causes which include unbalanced traction return currents and/or transmission interference. The receiving station further includes apparatus for determining a repetition rate of the received pulses and apparatus for decoding information from the determined repetition rate thereby to determine the particular data item being transmitted. Finally, there is included apparatus for displaying the particular data item.

25 Claims, 5 Drawing Figures

FAIL-SAFE CAB SIGNAL PROCESS FOR TRANSMITTING INFORMATION BY HIGH-VOLTAGE PULSED TRACK CIRCUITS, AND APPARATUS FOR CARRYING THE PROCESS INTO EFFECT

The invention relates to a fail-safe cab signal process for transmitting information by high-voltage pulsed track circuits between the ground and a rail vehicle and to an apparatus for carrying the process into effect.

As in all forms of cab signalling, it is an object of the invention to transmit items of information or data items originating on the ground to the driving cabs of rail vehicles so that the human or automatic forms of driver invigilation can drive the vehicles completely safely and in accordance with operating requirements. The transmission must of course be on a fail-safe basis as understood in the railway art — i.e., in no case must an equipment failure lead to a cab display of a less restrictive instruction than the instruction transmitted from the ground.

There are many kinds of cab signalling equipment in which the data are transmitted by coupling between receivers on board the driving vehicles and transmitters distributed along the track or a single transmitter (track cable). In the case of transmitters distributed along the track, data transmission must be intermittent. Since the transmission range of each transmitter is of course limited, the on-board receivers must be in a particular transmission area to receive or detect the corresponding data items. If data transmission is not to be excessively discontinuous, a very large number of transmitters are required. In the single-transmitter system, the track cable must be placed some far above the track, wherein it is exposed to the environment and can be struck by maintenance or other equipment moving along the track and increases the difficulty of track maintenance.

In contrast to the foregoing, this invention uses high-voltage pulsed track circuits of known kind to transmit the data items. The invention is free of the disadvantages of the systems described and its great advantage is that it makes continuous data transmission possible. Another advantage is that existing track circuits can be used and that control provision and checking provision need to be provided merely for each of the ground transmitters of the track circuits. If data items for transmission are given preliminary treatment on the ground, on the basis of relative priorities only a single data item needs to be transmitted at a time.

The theory behind the transmission is therefore to set various steps or values for the recurrence rate of the pulses transmitted to the track circuits by allotting a predetermined recurrence rate value to each data item. The pulses are picked up on board the driving vehicles and processed to remove interfering transmissions and to restore the transmitted recurrence rates which are converted into information displayed in the driving cab.

The invention relates first to a process for transmitting information by high-voltage pulsed track circuits between the ground and a rail vehicle, characterized in that:

on the ground in each block section, the data required to be transmitted are encoded by associating with each data item a predetermined value of the repetition rate of the pulses transmitted by the track circuit, the repetition rate of the transmitted pulses is checked to make sure that it corresponds with the repetition rate of the data item required to be transmitted, and on the vehicle the signals transmitted by the track are received, interfering signals being suppressed, the received pulses are regenerated the repetition rate of the received pulses is determined, such repetition rate is checked to make sure that it corresponds with one of the repetition rates used by the transmitter, the corresponding data item is decoded, the data item is displayed until it is replaced by the next data item.

The invention relates in the second place to an apparatus for carrying such process into effect and characterized in that it comprises:

on the ground in each block section, a high-voltage pulsed track circuit whose repetition rate is set at discrete steps each corresponding to a particular data item to be transmitted, provision for controlling the track circuit, provision for checking the repetition rate of the transmitted pulses, and on the vehicle, provision for receiving the pulses transmitted by the track, provision for processing the pulses received by the vehicle, and serving to suppress the effect of track traction return currents and some forms of transmission interference and to regenerate such pulses, provision for checking the repetition rate of such pulses, provision for decoding the data items corresponding to such repetition rate, provision in the vehicle driving cab for displaying the decoded data item.

The invention will be more clearly understood from the following description and from the accompanying drawings wherein.

Figure 5:
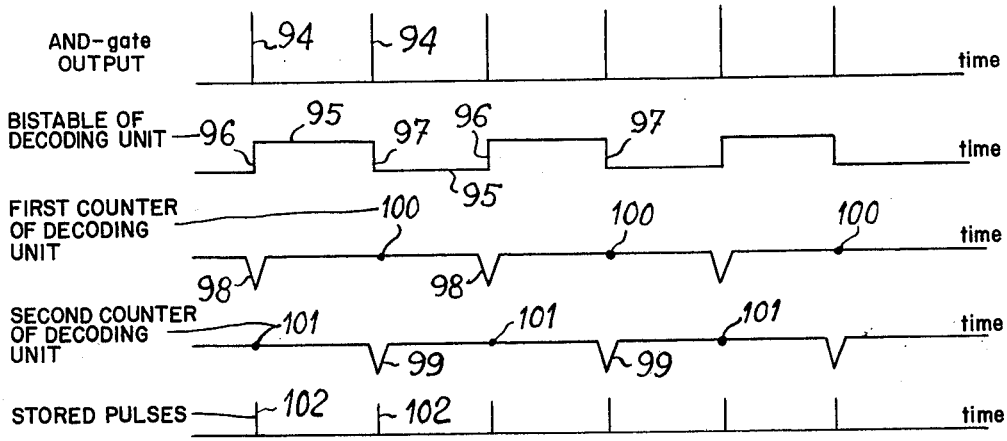

FIG. 5 consists of a number of diagrams to illustrate the operation of the main elements of the decoding unit.

Figure 1:
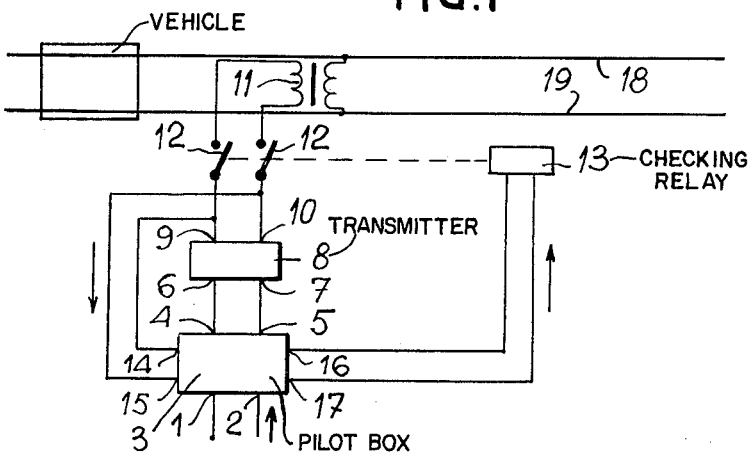
FIG. 1 is a diagrammatic view of the ground transmitting section of a high-voltage pulsed track circuit with its provisions for control and checking.

Referring to FIG. 1, data items for transmission are received at a first input 1,2 of a pilot box 3 containing the control and checking facilities (not shown in FIG. 1) of a transmitter 8 of a high-voltage pulsed track circuit. The first output 4,5 of box 3 is also an input 6,7 for transmitter 8. Output 9,10 thereof is connected to primary winding 11 of the track circuit transmitting transformer by way of contacts 12 of a checking relay 13 and to a second input 14,15 of box 3, a second output 16,17 of box 3 being connected to the winding of relay 13. The track comprises two lengths of rail 18,19. The control facility comprises a clock or timer and a logic system, and the checking facility comprises a selector for repetition-rate signals. This will be discussed below.

Figure 2:
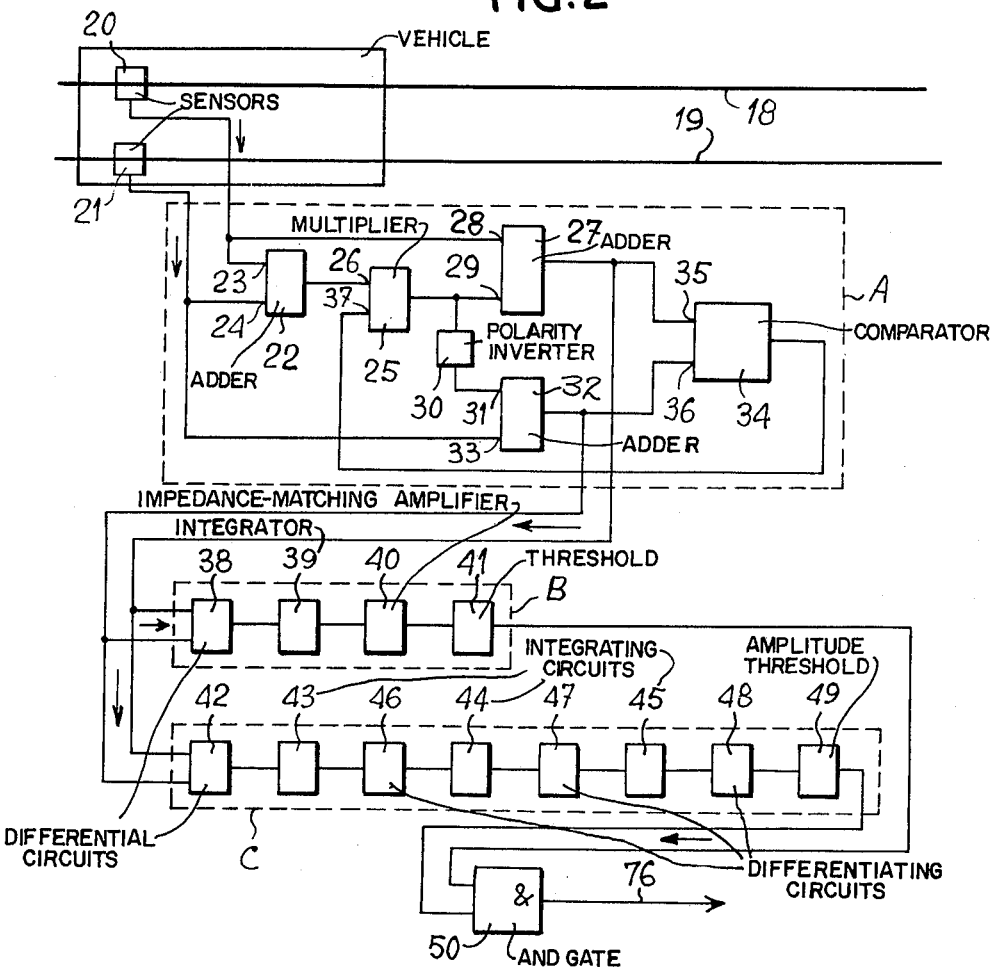
FIG. 2 is a diagram showing the on-board provision for detecting or receiving and processing the pulses transmitted by the track.

FIG. 2 shows: a receiving or detecting facility comprising two detectors or sensors 20,21 each disposed about 4 inches above one of the rails 18,19 and in advance of the leading axle; and a facility for processing the sensed or received pulses and comprising three units A, B, C (shown in broken lines) and a fail-safe AND-circuit. Each sensor or detector comprises a single winding with an open magnetic circuit an impedance matching amplifier so devised as in no case to be able to output a signal whose amplitude is greater than the amplitude of the detected or received signal.

In the first unit A a first adder 22 has its two inputs 23,24 connected to the outputs of the sensors 20,21 respectively. A multiplier 25 has its first input 26 connected to the output of the first adder 22. A second adder 27 has its first input 28 connected to the output of sensor 20 and its second input 29 connected to the output of multiplier 25. A polarity inverter 30 has its input connected to the output of multiplier 25 and its output connected to the first input 31 of a third adder 32 whose second input 33 is connected to the output of the second sensor 21. An amplitude comparator 34 has its inputs 35,36 connected to the outputs of the second and third adders respectively, the output of comparator 34 being connected to the second input 37 of multiplier 25. The units B and C are connected in parallel at the respective outputs of adders 27 and 32.

The second and fail-safe unit B comprises in series a first differential circuit arrangement 38, an integrator 39, a fail-safe impedance-matching amplifier 40 and a safety threshold 41.

The third unit C comprises in series a second differential circuit arrangement 42, three integrating circuits 43-45 each followed by a respective differentiating circuit 46-48, and an amplitude threshold 49. The outputs of the two units B,C are connected to the inputs of a fail-safe logic AND-circuit 50 (e.g. of the kind described in the Applicants' French Patent 2,147,481 of July 29, 1971 and their application for a First Addition No. 75.17672 of June 6, 1975 thereto) whose output 76 is connected to the input of a decoding system; the same is not shown in FIG. 2 but is shown in diagrammatic form in FIG. 4.

The AND-circuit 50 as shown in the above French patent and application of addition, as well as Australian Patent No. 440,160, published Sept. 27, 1973, illustrates two inputs, each having a positive pulse; two transistors, the base electrodes of which are connected to respective inputs; two transformers, each having primary and secondary windings, the outputs from the transformers being connected to respective primary windings; a third transistor whose base electrode is connected to the two secondary windings in series; a voltage divider circuit connected across a D.C. source for biasing the third transistor and also supplying the first and second transistors through the respective primary windings; a fourth transistor receiving the input of the third transistor; and an output associated with the fourth transistor from which a pulse can be supplied. Obviously, other known circuitry could also be used in place of the instant circuit as the AND-circuit 50.

Figure 3:
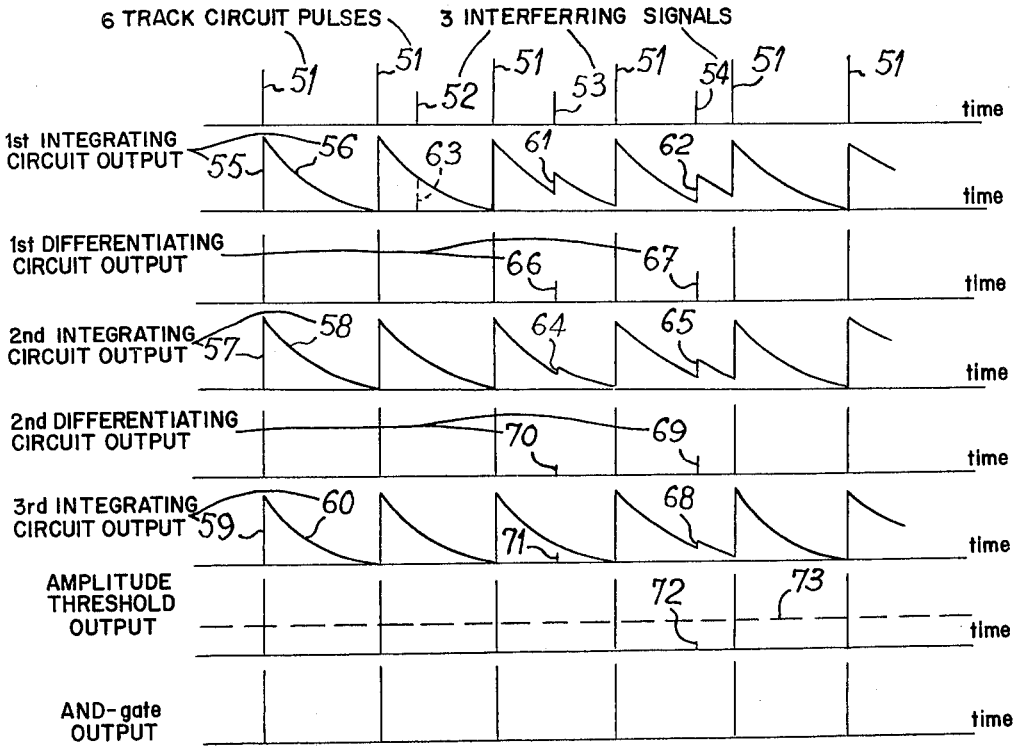
FIG. 3 is a diagram explaining elimination of three forms of interference.

Referring to FIG. 3, there can be seen six pulses 51 of the track circuit transmitter 8 and three interfering signals 52-54 whose amplitude is half the amplitude of the pulses 51 and which occur one-third of the way through the period, half-way through the period and two-thirds of the way through the period, respectively. Curves 55,56 represent the charge and discharge respectively of the capacitor (not shown in FIG. 2) of the integrator 43 upon the arrival of the first pulse 51. The curves 57,58 apply similarly to the integrator 44 and the curves 59,60 to the integrator 45.

The interfering signals 53,54 charge up the capacitor of integrator 43 to extents represented by references 61,62 respectively; the interfering signal 52 does not charge up the condenser and is shown in chain-dotted lines at 63. The references 64,65 denote the charging fronts of the capacitor of integrator 44 before the pulses 66,67 which are outputted by the differentiating circuit 46 and which themselves represent the charging fronts 61,62. Similarly, the reference 68 denotes the charging front of the capacitor of the integrator 45 before the pulse 69 output by the differentiating circuit 47. Pulse 70 representing the charging front 64 also output by circuit 47 is shown at 71. The pulse output by the differentiating circuit 48 and corresponding to the charging front 68 is shown at 72 and disappears after passing through the amplitude threshold 49 represented by the chain line 73. At the bottom of FIG. 3 there can be seen the pulses output by the AND-gate 50 after suppression of interference.

Figure 4:
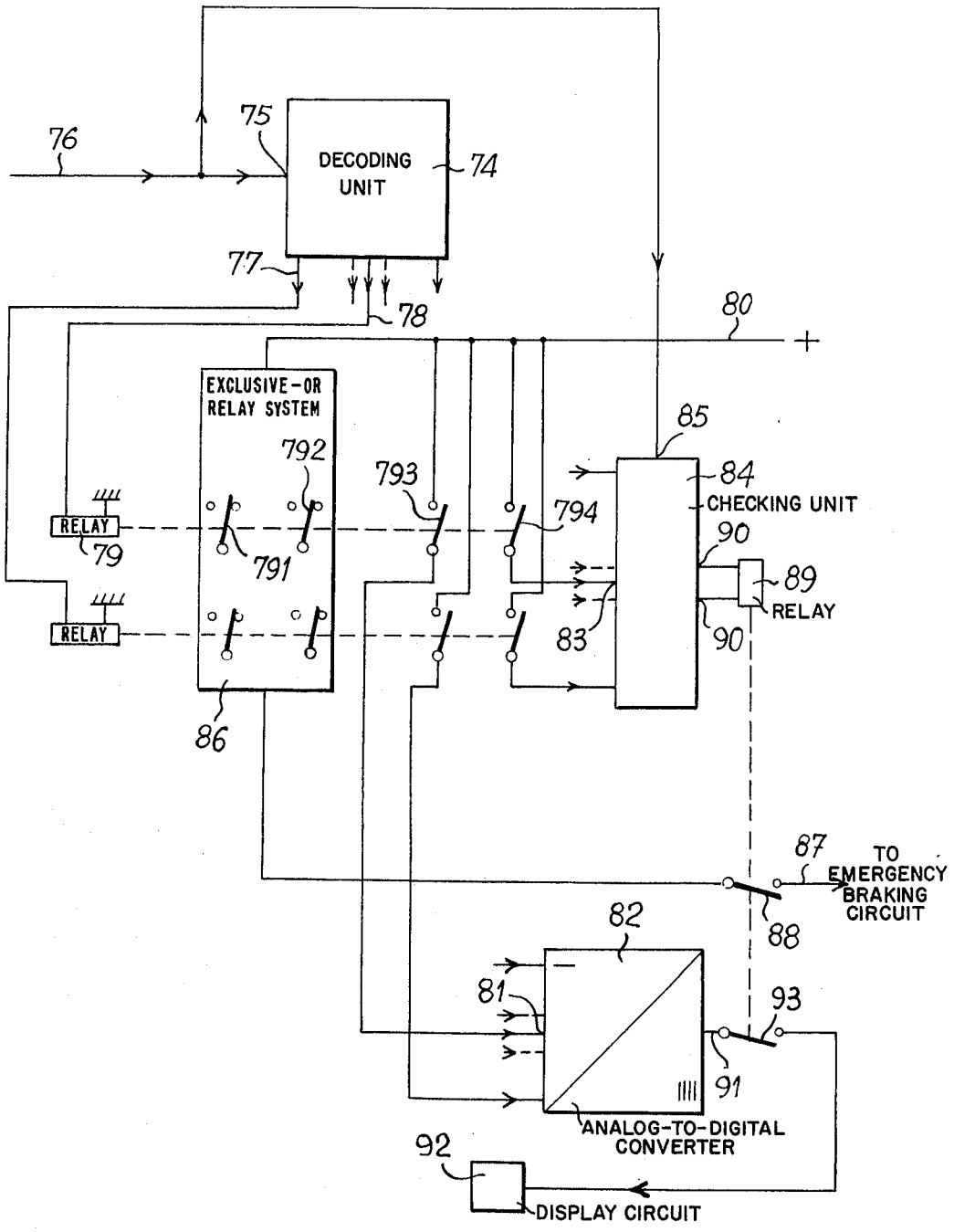
FIG. 4 is a diagrammatic view of the decoding unit.

FIG. 4 shows the actual decoding unit 74. Input 75 thereof is connected to output 76 of AND-gate 50. Of its outputs, which are to the same number as there are data items transmitted via output 76, only two 77,78 are shown, the others being indicated by arrowed broken lines extending from unit 74. For instance, output 78 controls a corresponding relay 79 which has two two-way switching contacts 791, 792 and two normally open (no) contacts 793, 794. The first no contact 793 connects a d.c. supply 80 to input 81 of an analog-to-digital converter 82. The second no contact 794 connects supply 80 to input 83 of a checking or verification unit 84 having inputs equal to the number of outputs of the decoding unit 74. Checking unit 84 has a selector for recurrence-rate signals and a delay circuit, such selector and such circuit both being of the fail-safe kind and not being shown in FIG. 4, but discussed below in relation to French Patent 2,176,266 of Mar. 17, 1972 and a corresponding application for an Addition thereto No. 75,17673 of June 6, 1975 and by French Patent No. 2,183,304 of Mar. 22, 1972.

A relay similar to 79 is associated with each output similar to 78, so that a relay system having as many relays as there are data items to be transmitted is provided, each relay being a means of connecting the d.c. supply 80 to a corresponding input of the analog-to-digital converter 82 and to a corresponding input of the checking or verification unit 84.

AND-gate output 76 is connected to the special input 85 of checking unit 84. The two-way switching contacts as 791, 792, of the relay system are connected on an exclusive-OR basis as indicated by the reference 86. This circuit arrangement connects the d.c. supply 80 to an emergency braking circuit 87 by way of the first contact 88 of an output relay 89 controlled by output 90 of checking unit 84. Output 91 of converter 82 is connected to a cab information display circuit 92 via the second contact 93 of relay 89.

Referring to FIG. 5, there can be seen the first two pulses 94 delivered by output 76 of AND-gate 50 and the various phases 95 of a bistable with a leading edge 96 and a trailing edge 97. The reference 98 denotes restarts of a first counter which are produced by leading edges 96, 99 and restarts of a second counter which are produced by the trailing edges 97. The predetermined states of each counter, such states being to the same number as there are data items to be transmitted, have the references 100, 101 for the first counter and second counter respectively. The reference 102 denotes stored pulses. The bistable and the two counters form part of the decoding unit 74 and are not shown in FIG. 4.

The apparatus according to the invention operates as follows:

A narrow repetition-rate band is allotted to each data item; consequently, to transmit a given data item on a given section of track the track-circuit transmitters of such section must be so controlled that the pulses they transmit to the track are restricted to the repetition-rate band allotted to the particular data item transmitted. Also, changeover between data items — i.e., from operation in one band of recurrence rates to operation in another such band — must be able to be carried out very quickly at any time.

As indicated in FIG. 1, the timer of the control circuit of box 3 delivers signals controlling the repetition rate of the pulses delivered at the output 9,10 of track-circuit transmitter 8. The recurrence rate of the pulses thus transmitted is compared in the repetition-rate selector of box 3 (which is of the same type as used in conjunction with unit 84) with the recurrence rate to which such selector has been switched by the logic system of the control circuit of box 3. If the recurrence rates are the same, the selector acts on the control winding of checking or verification relay 13 which closes its contacts 12 and thus permits the pulses of the transmitter 8 to go to primary winding 11 of the track circuit transmission transformer. If the rates are found to differ from one another, the selector opens the contacts 12 and thus prevents wrong information from being transmitted to the track.

Selectors of the kind disclosed by the Applicants' French Patent 2,176,266 of Mar. 17, 1972 and a corresponding application for an Addition thereto No. 75 17673 of June 6, 1975 and by French Patent No. 2,183,304 of Mar. 22, 1972 are particularly suitable for use with the apparatus described. If a selector of such a kind is used together with a fail-safe relay 13, and since the logic systems controlling switching of the timer and operation of the selector are independent, the system operates on a fail-safe basis.

The circuit arrangement includes two capacitors which are charged through resistors from a stabilized D.C. supply; when the voltage of the first capacitor reaches a particular value, it is kept constant and the second capacitor discharges through a resistor; any pulse appearing upstream of the first capacitor causes the discharge thereof; the latter discharge causes the second capacitor to discharge to the primary winding of a transformer; if the residual charge of the second capacitor is still sufficient at the time of the discharge, the current pulse produced across the transformer secondary winding triggers oscillations in a capacitive circuit coupled with the transformer primary; and the constant-amplitude pulses of the oscillations are transmitted via a coupling capacitor to a shaping circuit arrangement which takes the envelope of the transmitted oscillations and converts such envelope after amplification into a substantially rectangular signal. Obviously, other similar known devices could be used.

Referring to FIG. 2, each of the sensors 20,21 outputs a voltage reflecting current variations in the rail below it, the latter current being the sum of the traction return current of that particular rail, of the track circuit pulses and of some forms of interference. If the traction return current were to divide exactly equally through each rail 18,19, a simple differential circuit arrangement of the sensors 20,21 for the two rails would eliminate traction return current effect and retain only the track circuit pulses, which latter are of the same amplitude as one another but in phase opposition in the two rails. In practice there is a very random distribution of the traction return current between the two rails.

However, imaginary balanced distribution conditions can be achieved if the data items supplied by each of the sensors 20,21 have superimposed upon them traction return current percentages weighted appropriately to restore the balance. This is what the first unit A of the processing facility does.

If the compensation for simulating a balanced distribution of the traction return current between the two rails is correct, the mean values of the output amplitudes of the adders 27,32 are equal (the mean value of the track circuit pulses being zero) and the voltage at the output of amplitude comparator 34 is zero. If the compensation is unsatisfactory, the voltage at the output of comparator 34 can be considered to be an error signal which is applied to the second input 37 of multiplier 25 to provide a closed-loop control ensuring that the required compensation is provided correctly.

Because of this control, the balanced traction return currents in the outputs of the adders 27,32 can be cancelled out by connecting the latter outputs to the inputs of the first differential circuit arrangement 38 of the second unit B and to the inputs of the second differential circuit arrangement 42 of the third unit C, the outputs of the latter circuit arrangements then containing only the track circuit pulses and some forms of interference arising either from the traction currents (pantograph or shoe bounce) or from the transmission. To obviate or reduce the effect of the latter forms of interference, the signals outputted by the two differential circuit arrangements are processed by the remainder of the units B,C respectively. The threshold 41 of the second unit B and the integration provided by 39 eliminate some of the forms of interference, particularly the high-frequency forms, but there is still too much interference for undisturbed transmission of the track circuit pulses. The remaining interference is eliminated by the second unit C which uses the amplitudes of the voltages picked up by the detectors 20,21 and is far more sensitive to the growth times of the signals than to their amplitude.

Each integrating circuit 43–45 basically comprises a capacitor which charges up to the peak value of the signal received at the circuit input and which discharges at a given time constant which is deliberately chosen to be less than the shortest of the track circuit pulse periods. For instance, in FIG. 3 the top of the substantially vertical line 55 represents the peak value of the first pulse 51. The capacitor of the integrating circuit 43 has finished discharging, indicated by line 56, before the arrival of the second pulse 51.

The differentiating circuit following each of the integrating circuits responds only to abrupt voltage variations at the integrating circuit output and so records substantially only the fronts or leading edges charging up the capacitor and therefore eliminates all forms of interference which have too low an amplitude and are too near the track circuit pulse preceding them to cause any appreciable variation in the charge of the capacitor.

For instance, the differentiating circuit 46 records only the charging fronts 61,62 by outputting pulses 66,67 and eliminates interfering signal 63, which has too small an amplitude and which is too near the second pulse 51 to produce any appreciable variation in the remaining charging of the capacitor of integrating circuit 43.

Forms of interference which are of sufficient amplitude or which are near enough the termination of discharging of the capacitor to cause appreciable recharging thereof have their amplitude attenuated by the differentiating circuit, the attenuation being greater in proportion as such interference is nearer the track circuit pulse which precedes it. For instance, in FIG. 3 the interfering signal 53, which is nearer the third pulse 51 than the interfering signal 54 is to the fourth pulse 51, causes the differentiating circuit 46 to output a pulse 66 of less amplitude than the pulse 67.

After their attenuation as they pass through the integrating circuits and then through the consecutive differentiating circuits, most of the remaining forms of interference are eliminated by the amplitude threshold at the output of the units B and C. The first interfering signal 52 is eliminated by the first differentiating circuit 46, the second interfering signal 53 is eliminated by the third differentiating circuit 48 and the third interfering signal 54 is eliminated by the amplitude threshold 49, of which the chain line 73 represents the output signal.

The third interference-eliminating unit C is not fully fail-safe — i.e., in the event of malfunctioning it might amplify some forms of interfering signal.

So that the operation of the processing device may remain fail-safe, the outputs of the two units B, C drive simultaneously the two inputs of the fail-safe AND-gate 50. Output 76 thereof therefore delivers regenerated pulses which restore the recurrence rates of the track circuit pulses.

The decoding unit 74 of FIG. 4 is known and contains elements which are not shown in FIG. 4 and which are a bistable, two counters, two decoding matrices, two clocks or timers and a two-pulse safety counter.

FIG. 5 shows the operation of the main elements of the decoding unit 74, such elements being the bistable and the two counters. A decoding assembly of the type illustrated in United States Patent No. 3,800,139 could be incorporated herein. The regenerated pulses 94 delivered at AND-gate output 76 are applied to the bistable which changes its state on the receipt of each pulse, as indicated by leading edge 96 and trailing edge 97 of operating diagram 95 of the bistable. At each change of state the bistable zero resets and starts two binary counters which are called on alternately. The first restart 98 of the first counter corresponds to the leading edge 96 and the first restart 99 of the second counter corresponds to the trailing edge 97. Each such counter is piloted by a clock or timer operating on a frequency of the order of 10 kHz and has as many predetermined states 100,101, decoded by means of two diode matrices, as there are data items to be received on board the vehicles. Whenever a counter is in any of the predetermined states at the time when reception of the next pulse causes the bistable to change its state, the information corresponding to such predetermined state is stored.

In FIG. 5 the second pulse 102 corresponding to storage of a data item occurs when, with the second counter in the first predetermined state 101, the second pulse 94 changes the state of the bistable (trailing edge 97). The information thus stored is taken into consideration and displayed in the cab only if the information immediately following it confirms it — i.e., if the second counter, which started upon storage of the information, is in the same predetermined state at the time of reception of the next pulse.

In practice, a diode matrix decodes the $n$ predetermined states for each counter with a spread or differential of the order of $+1\%$. When the $p-1\%$ state is reached, the corresponding data item or information is stored. The storage is destroyed by decoding of the $p+1\%$ state or by reception of the next pulse if such reception occurs before decoding of the $p+1\%$ state.

In this case the data item is transferred, before destruction of storage, to a safety counter which counts two consecutive data items while awaiting decoding of the next data item by which it must be confirmed in order to be taken into consideration. The data item thus taken into consideration is transmitted e.g. via output 78 (FIG. 4) for display in the cab, but since the decoding unit 74 is not a fail-safe device, the validity of the information thus displayed must be checked by making sure that it really does correspond to the recurrence rate of the track circuit pulses. This checking is carried out by the checking unit 84 whose selector — of the same kind as the selector of box 3 — is synchronized by the regenerated pulses output by the AND-gate 50 to the special input 85; the actual selector frequency is switched by the data item on display to the value corresponding to such data item. For instance, the relay 79 is actuated by output 78 to close its second no contact 794.

If the sync pulse repetition rate is identical to the actual frequency to which the selector has thus been switched, the selector gates such pulses which supply the delay circuit of the unit 84. The function of the delay circuit — as disclosed in the Applicant Company's French Patent Application No. 74,23001 of July 2, 1974 published under No. 2,277,426 — is to maintain continuity of the display of information in the cab despite the presence of inevitable decoding gaps even when the cab signal system is operating completely normally, for decoding gaps occur regularly when the wheels pass over insulated joints between track circuits and at changeovers of data. The delay circuit maintains the display of the information displayed before the occurrence of the decoding gap until the selector for recurrence-rate signals has checked the validity of the new decoded item of information, such item then being displayed, the delay circuit being reset again. The time for which the display must be maintained in this way must be greater than the time of the largest possible decoding gap in the absence of any malfunctioning while remaining compatible with the maximum permissible time in the light of operating safety.

Such a fail-safe time delay as illustrated in the above French publication includes a first capacitor charged by a unidirectional voltage source through an adjustable resistor, an oscillator generating a sinusoidal voltage which is converted into pulses by a pulse shaper acting on the gate of a field-effect transistor for discharging the first capacitor through the primary winding of the first transformer in the form of pulses which successively pass through a voltage threshold, and a first amplifier controlling a gate through a second transformer, the said gate enabling a second amplifier to amplify the signals of the oscillator through a third transformer, and the output of the second amplifier being connected by a fourth transformer to a rectifier which supplies the windings of the relay, and a capacitive coupling between the oscillator and the positive terminal of the first capacitor.

In FIG. 4, the relay 89 operated by output 90 of the safety unit 84 closes its contacts 88,93 to cut out the emergency braking and to enable the circuit 92 to display the corresponding data item after the control unit 84 has made its check.

If the sync pulse frequency differs from the selector's own frequency, output 90 of unit 84 operates relay 89 which opens contact 88 for an emergency brake application and also opens contact 93 to cancel the information display.

If two data items are transmitted by two outputs of the unit 74 simultaneously, the simultaneous closure of two two-way switching contacts of the exclusive OR relay system 86 opens the circuit 86 to make an emergency brake application.

The invention is of use more particularly for driving underground trains.

We claim:

1. A method for communicating information comprising a plurality of data items to a rail vehicle by transmission of pulses at predetermined repetition rates along railway tracks comprising the steps of:
   a) encoding each of said data items as pulses occurring at a selected repetition rate;
   b) transmitting said pulses at said selected repetition rate along said tracks;
   c) receiving said pulses;
   d) removing interference signals from said pulses, said interference signals attributable to a number of causes, which include:
      i) unbalanced traction return currents, and/or
      ii) transmission interferences;
   e) regenerating said received pulses;
   f) determining the repetition rate of said received pulses;
   g) decoding information from said determined repetition rate, and
   h) indicating the decoded information in said rail vehicle.

2. A method as recited in claim 1 wherein said transmitting step comprises the step of checking said selected repetition rate with said predetermined repetition rates to ascertain whether said predetermined rates include said selected rate.

3. A method as recited in claim 2 wherein said transmitting step further comprises the step of enabling said transmission only after said checking step has ascertained that said predetermined rates include said selected rate.

4. A method as recited in claim 1 wherein said removing step further comprises the step of suppressing effects of unbalanced track return currents from said communicated information.

5. A method as recited in claim 4 wherein said suppressing step comprises the steps of:
   a) receiving said communicated information in two signals, one signal being received from each track, and
   b) weighting the two signals to compensate for differences in levels of track return currents in each track.

6. A method as recited in claim 4 wherein said removing step further includes the step of eliminating noise signals occurring between said transmitted pulses from said communicated information.

7. A method as recited in claim 6 wherein said removing step further comprises the step of deleting high frequency interference signals from said received pulses.

8. A method as recited in claim 7 wherein said decoding step further comprises the step of
   checking said determined repetition rate with said predetermined repetition rates to ascertain whether said predetermined rates include said determined rate.

9. A method as recited in claim 1 wherein said removing step further includes the step of eliminating noise signals occurring between said transmitted pulses from said communicated information.

10. A method as recited in claim 9 wherein said removing step further comprises the step of deleting high frequency interference signals from said received pulses.

11. A method as recited in claim 9 wherein said eliminating step comprises the steps of:
   a. integrating said received pulses and noise signals to produce an integrated signal;
   b. differentiating said integrated signal, and
   c. discriminating said differentiated signal for pulses exceeding a selected threshold.

12. A method as recited in claim 11 wherein said eliminating step, prior to said differentiating step, further comprises the additional steps of:
   a. differentiating said integrated signal and producing a first signal;
   b. integrating said first signal and producing a second signal;
   c. differentiating said second signal and producing a third signal;
   d. integrating said third signal and producing a fourth signal.

13. A method as recited in claim 1 wherein said decoding step further comprises the step of checking said determined repetition rate with said predetermined repetition rates to ascertain whether said predetermined rates include said determined rate.

14. An apparatus for communicating information comprising plural items of data between a first station and a rail vehicle by transmission of pulses at predetermined repetition rates along railway tracks comprising:
   a. a transmitting station for generating information pulses for transmission, comprising:
      1. control means receiving a particular data item as an input for selecting a repetition rate to represent said particular data item for transmission, and
      2. generating means connected to said control means for generating said information pulses;
   b. railway tracks for transmitting said generated information pulses thereon;
   c. coupling means for coupling said information pulses to said tracks;
   d. a receiving station receiving said information pulses from said tracks, comprising:
      1. sensing means for sensing said information pulses from said tracks,
      2. means for removing interference signals received along with said information pulses from said tracks, said interference signals attributable to a number of causes which include:
         i. unbalanced traction return currents, and/or
         ii. transmission interferences 3. means connected to said removing means for determining a repetition rate of said received pulses,
4. means for decoding information from said determined repetition rate thereby to determine the particular data item transmitted, and
5. means for indicating said particular data item.

15. Apparatus as recited in claim 14 wherein said transmitting station further comprises:
a. checking means for determining whether said selected repetition rate is included within said predetermined repetition rates, and
b. enabling means responsive to said checking means for enabling transmission of said information pulses only when said selected repetition rate corresponds to one of said predetermined repetition rates.

16. Apparatus as recited in claim 14 wherein said removing means further comprises means for suppressing interference signals, arising from return current in said tracks, from received information.

17. Apparatus as recited in claim 16 wherein said sensing means comprises one sensor for each of said railway tracks, each sensor generating a signal.

18. Apparatus as recited in claim 17 wherein said removing means comprises weighting means for weighting said sensor signals to compensate for unbalance in said track return current.

19. Apparatus as recited in claim 18 wherein said weighting means comprises:
a. first adding means having two inputs and an output for adding said sensor signals, whereby a sum signal representative of total track return current is provided at said output,
b. multiplying means having two inputs and an output, a first of said inputs receiving said sum signal from said first adder means for multiplying said sum signal by a DC control voltage connected to a second input of said multiplying means, thereby varying the amplitude and phase of said sum signal,
c. second adding means having two inputs and an output for adding the output of said multiplying means and a signal from one of said sensors,
d. polarity inverting means having an input and an output for inverting the output signal of said multiplying means,
e. third adding means having two inputs and an output, a first input receiving the output of said polarity inverting means and a second input receiving an output signal of a second of said sensors on said two inputs, for performing an addition thereof,
f. amplitude comparing means having two inputs, connected respectively to outputs of said second and third adding means, for comparing the output signals of said second and third adding means and providing said DC control voltage to said multiplying means, said control voltage proportional to an average value of differences between the outputs of said second and third adding means and having a sign representing the sign of said difference, whereby said second and third adding means provide signals representative of said sensor signals with compensation for unbalance of said track return current.

20. Apparatus as recited in claim 17 wherein said removing means comprises first eliminating means for eliminating a form of transmission interference, comprising in series:
a. first differential circuit means having two inputs and an output, said inputs each receiving a signal from said sensing means,
b. first integrating means receiving said output of said first differential circuit means and having an output,
c. fail-safe impedance matching means receiving said output of said integrating means and having an output,
d. first threshold means receiving said output of said fail-safe impedance matching means for eliminating signals having amplitudes below a selected value and producing an output signal for said determining means, whereby a form of interference signal is eliminated.

21. Apparatus as recited in claim 17 wherein said removing means further comprises second eliminating means for eliminating noise signals occurring between said transmitted pulses from said communicated information, comprising:
a. second differential circuit means having two inputs and an output, said two inputs connected to outputs of said second and third adders,
b. second integrating means receiving said output of said second differential circuit means and having an output,
c. first differentiating means receiving said second integrating means output and having an output,
d. third integrating means receiving said output of said first differentiating means and having an output,
e. second differentiating means receiving said output of said third integrating means and having an output,
f. fourth integrating means receiving said output of said second differentiating means and having an output,
g. third differentiating means receiving said output of said fourth integrating means and having an output,
h. second threshold means receiving said output of said third differentiating means and having an output, whereby interference pulses occurring closer to a preceding information pulse are more easily eliminated than pulses occurring further from a preceding information pulse, and those occurring closer to a succeeding information pulse are attenuated and eliminated, the second threshold means eliminating any such pulses which have not been eliminated by said integrating and differentiating means.

22. Apparatus as recited in claim 21 wherein said removing means further comprises a first eliminating means for eliminating a form of transmission interference, comprising in series:
a. first differential circuit means having two inputs and an output, said inputs each receiving a signal from said sensing means,
b. first integrating means receiving said output of said first differential circuit means and having an output,
c. fail-safe impedance matching means receiving said output of said integrating means and having an output,
d. first threshold means receiving said output of said fail-safe impedance matching means for eliminating signal having amplitudes below a selected value and producing an output signal for said determining means, whereby a form of interference signal is eliminated.

23. Apparatus as recited in claim 22 further comprising fail-safe circuit means comprising AND gate means having:

a. first and second inputs, said first and second inputs connected to said output signal of said first threshold means and to said output of said threshold means, b. an output means providing thereon regenerated pulses corresponding to said transmitted pulses.

24. Apparatus as recited in claim 22 wherein said removing means further comprises weighting means for weighting said sensor signals to compensate for unbalance in said track return current.

25. Apparatus as recited in claim 14 wherein said means for determining comprises checking means for comparing said determined repetition rate with said predetermined repetition rates for ascertaining whether said predetermined rates include said determined rate.

* * * * *